US005261541A

United States Patent [19]

Li

[11] Patent Number: 5,261,541

[45] Date of Patent: Nov. 16, 1993

[54] RECEPTACLE FOR RECEIVING UMBRELLAS

[76] Inventor: Ching-Po Li, P.O. Box 82-144, Taipei, Taiwan

[21] Appl. No.: 980,232

[22] Filed: Nov. 23, 1992

[51] Int. Cl.[5] ..... A47F 7/00

[52] U.S. Cl. ..... 211/62; 312/229

[58] Field of Search ..... 211/62; 312/229

[56] References Cited

U.S. PATENT DOCUMENTS

| | | | |
|---|---|---|---|
| 664,600 | 12/1900 | Weitman | 211/62 |
| 791,997 | 6/1905 | Bagby | 312/229 X |
| 1,013,662 | 1/1912 | Kramer | 211/62 |
| 1,476,599 | 12/1923 | DeWitt | 211/62 |
| 1,561,014 | 11/1925 | O'Rourke | 211/62 X |
| 2,373,339 | 4/1945 | Roberts | 211/62 X |
| 2,614,698 | 10/1952 | Bell | 211/62 |
| 3,136,426 | 6/1964 | Sakuma | 211/62 |
| 3,661,270 | 5/1972 | Lucci et al. | 211/62 |

*Primary Examiner*—Robert W. Gibson, Jr.
*Attorney, Agent, or Firm*—Alfred Lei

[57] ABSTRACT

This invention relates to a receptacle for receiving umbrellas and in particular to one including a housing provided with a plurality of conical recesses which water may penetrate through, a sleeve enclosing and being separated from each of the conical recesses and having a water outlet thereby forming a passage between the sleeve and each of the conical recesses, a pump disposed under the sleeve, and a container mounted under the water outlet of the sleeve and the pump, whereby the water attached on the umbrellas may be automatically removed and dried.

5 Claims, 3 Drawing Sheets

RECEPTACLE FOR RECEIVING UMBRELLAS

BACKGROUND OF THE INVENTION

It has been found that the prior art receptacle for receiving umbrellas is simply a container which has no other functions except receiving the umbrellas.

Hence, it is an object of the present invention to provide an improved receptacle for receiving umbrellas which may automatically dry and remove rain water attached on the umbrellas.

SUMMARY OF THE INVENTION

This invention relates to a receptacle for receiving umbrellas.

It is the primary object of the present invention to provide a receptacle for receiving umbrellas which may automatically dry and remove rain water attached on the umbrellas.

It is another object of the present invention to provide a receptacle for receiving umbrellas which is simple in construction.

It is still another object of the present invention to provide a receptacle for receiving umbrellas which is inexpensive to produce.

It is still another object of the present invention to provide a receptacle for receiving umbrellas which is easy to operate.

It is a further object of the present invention to provide a receptacle for receiving umbrellas which is practical in use.

Other objects and merits and a fuller understanding to the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
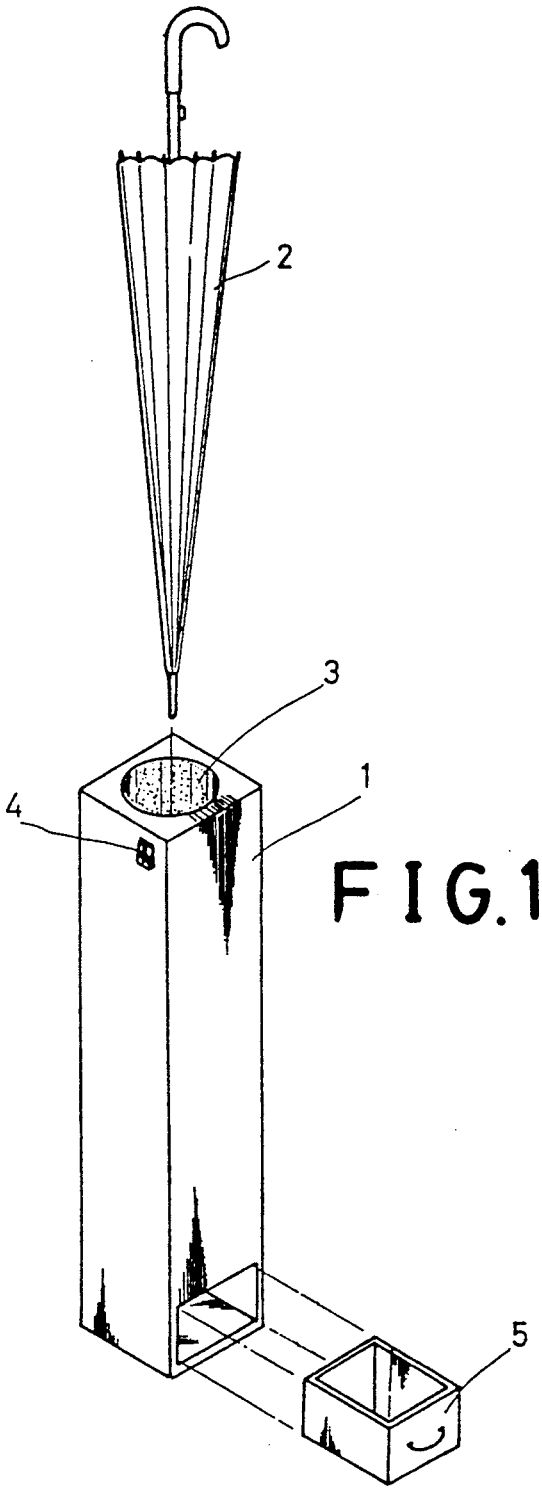
FIG. 1 is a perspective view of the present invention.
Figure 2:
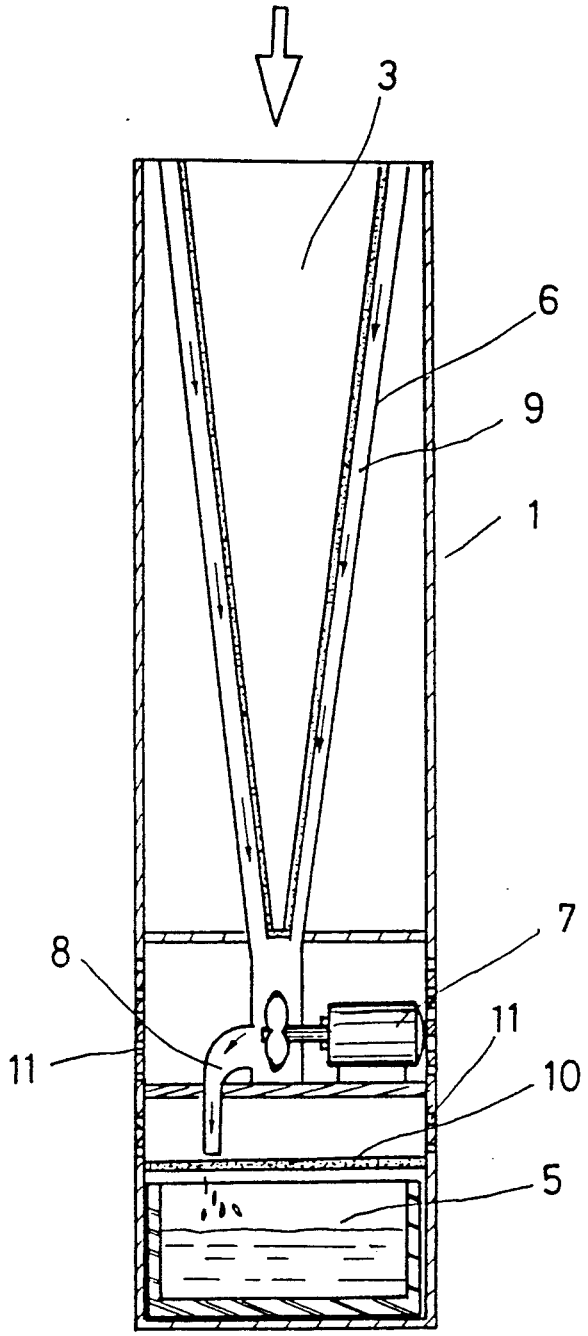
FIG. 2 is a sectional view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the present invention comprises a housing 1, a switch 4 mounted on one side of the housing 1, and a container 5 fitted in the lower portion of the housing 1. The housing 1 is formed with a conical recess 3 which is made of a net member, a plastic sheet with a plurality of holes, cloth, or the like. The conical recess 3 is enclosed with a sleeve 6 thereby forming a passage 9 between the conical recess 3 and the sleeve 6. Under the sleeve 6 there is a pump 7 and a water outlet 8. The pump 7 is electrically connected with the switch 4. A filtering net 10 is disposed under the water outlet 8 and the container 5 is located below the filtering net 10 which is designed for preventing water from springing upwards. A plurality of perforations 11 are provided on the housing 1 and located above the container 5 for the passage of air.

When in use, simple insert an umbrella 2 into the conical recess 3 of the housing 1 and turn on the switch 4 to actuate the pump 7. Then, the rain water attached on the umbrella 2 will be sucked down through the passage 9 and water outlet 8 into the container 5 thereby drying the umbrella 2.

Figure 3:
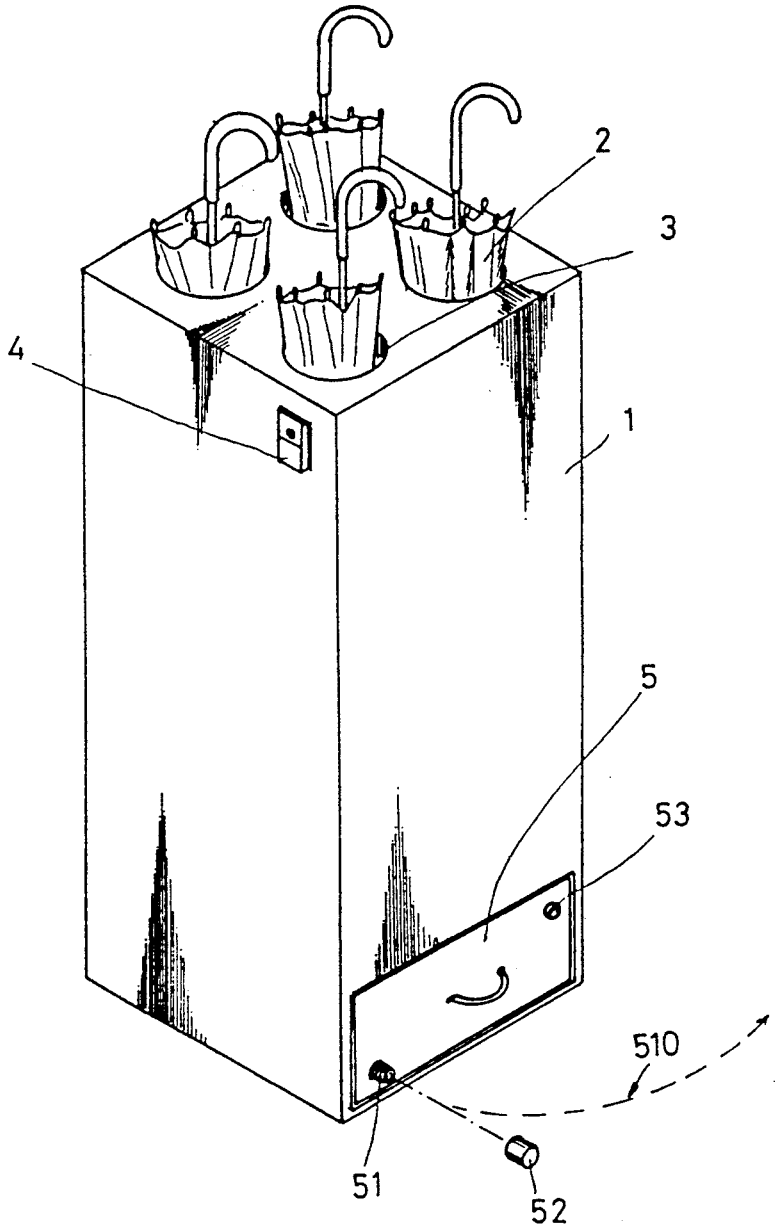
FIG. 3 is a working view of the present invention.

FIG. 3 shows another preferred embodiment of the present invention. As illustrated, the housing 1 is provided with a plurality of conical recesses 3. In addition, the container 5 has a water outlet 51 which is connected with a plug 52 so that when the water in the container 5 exceeds a predetermined level, an indicator 53 will produce a warning signal and turn off the pump 7 thereby preventing water from overflowing out of the container 5. The structure of such indicator 53 is well known in the art and will be described here in detail. In addition, the water outlet 51 of the container 5 may be directly connected with a flexible tube for draining water away.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A receptacle for receiving umbrellas comprising:
   - a housing provided with a plurality of conical recesses which water may penetrate through;
   - a sleeve enclosing and being separated from each of said conical recesses and having a water outlet thereby forming a passage between said sleeve and each of said conical recesses;
   - a pump disposed under said sleeve; and
   - a container mounted under the water outlet of said sleeve and said pump.

2. The receptacle for receiving umbrellas as claimed in claim 1, further comprising a filtering net between the water outlet of said sleeve and said container.

3. The receptacle for receiving umbrellas as claimed in claim 1, further comprising an indicator which will produce a warning signal and turn off said pump when water in said container exceeds a predetermined level.

4. The receptacle for receiving umbrellas as claimed in claim 1, wherein said container has a water outlet connected with a plug.

5. The receptacle for receiving umbrellas as claimed in claim 1, wherein said housing is provided with plurality of perforations for air passage.

* * * * *